United States Patent [19]

Bryant

[11] 4,103,235

[45] Jul. 25, 1978

[54] TWO-TONE ATTENTION SIGNAL BROADCASTING SYSTEM

[76] Inventor: Patrick Doyle Bryant, 2310 Garfield, Apt. 5, Lincoln, Nebr. 68502

[21] Appl. No.: 711,486

[22] Filed: Aug. 4, 1976

[51] Int. Cl.[2] ..... H04H 9/00

[52] U.S. Cl. ..... 325/64; 325/39; 325/55; 325/364; 325/341; 340/164 B

[58] Field of Search ..... 325/64, 39, 55, 395, 325/302, 341, 349, 364, 155; 340/164 R, 164 B, 167 B, 16 C

[56] References Cited

U.S. PATENT DOCUMENTS

| | | | |
|---|---|---|---|
| 2,671,167 | 3/1954 | Kulansky | 325/155 |
| 3,535,636 | 10/1970 | Muilwijk | 325/64 |
| 3,676,780 | 7/1972 | Niemann et al. | 325/55 |
| 3,714,595 | 1/1973 | Denenberg et al. | 179/15 BT |
| 3,772,241 | 11/1973 | Grosser et al. | 325/364 |
| 3,845,391 | 10/1974 | Crosby | 325/64 |
| 3,909,722 | 9/1975 | Bennett Jr., | 325/349 |
| 4,010,460 | 3/1977 | Derosa | 325/64 |

*Primary Examiner*—Robert L. Griffin
*Assistant Examiner*—Tommy P. Chin
*Attorney, Agent, or Firm*—Vincent L. Carney

[57] ABSTRACT

To broadcast a two-tone attention signal to receivers, a two-tone generator includes an interrupt switch, which, when a button is depressed, interrupts the audio signal from a broadcasting station and instead applies two combined frequencies which have been generated to the broadcast audio chain to modulate the carrier with the two-tone attention signal and broadcast it. To generate the two frequencies, a single clock frequency is applied to two different frequency dividers which digitally divide the clock frequency into the desired two tones. The two frequencies from the two dividers are applied to sine-wave generators which first differentiate the pulses from the digital circuits and then apply them to tank circuits. The time duration of the two signals is controlled by a digital system which counts 60 Hertz pulses for a predetermined time period after the button is depressed prior to terminating the two-tone attention signal. The receiver-decoder includes a ready lamp that is illuminated by the audio from the station, a timer similar to the timer used in the transmitter, and an automatic reset circuit that is delayed from the turn on time of the receiver-decoder.

19 Claims, 8 Drawing Figures

TWO-TONE ATTENTION SIGNAL BROADCASTING SYSTEM

This invention relates to emergency broadcast warning signals, more particularly to the generation and decoding of signals broadcast in the event of an emergency by radio and televison stations.

In the past, the FCC has required participating broadcast stations to have equipment for broadcasting a warning signal in the form of a carrier-break followed by a 1000 Hertz tone. The FCC now requires two tones to be broadcast simultaneously at 853 and at 960 Hertz with a variation of less than plus or minus ½ Hertz for a period of time between 20 seconds and 25 seconds.

One class of such two-tone broadcasting equipment includes a manual switch, that when depressed, causes an interrupt switch to interrupt the audio signal from the broadcast studio and a generator to generate the two-tone signals and a circuit that combines the two signals for application to the amplification, modulation and broadcast equipment through the interrupt switch for broadcasting.

Conventional implementing of such a system suggests that: (1) the time that the warning signals are broadcast is controlled by an analog circuit such as an RC circuit; and (2) two sine-wave signals are generated in tank circuits for combination and application through the interrupt switch to the amplification and modulation equipment and antennas. Such circuitry is known in other types of tone transmitting systems.

This type of prior-art system has the disadvantage of being relatively expensive and not as precise as desired. The expense occurs because timing equipment with the required accuracy and the equipment necessary to generate the sine waves are expensive.

Signaling systems are known which are digital in nature and generate the two frequencies digitally, convert them to sine waves, and combine these sine waves for broadcasting. Such a system is disclosed in U.S. Pat. No. 3,676,780 to Niemann. However, this type of equipment has relatively high distortion and low accuracy in the timing of the signals.

One cause of the distortion is that the digital signals are applied directly without differentiation to resonant tank circuits for conversion to sine waves and this results in high distortion. This distortion coupled with other additional forms of distortion which could result from the application of the signals through the ordinary telephone wires from the interrupt switch are a disadvantage which would impede the direct use of such equipment in a two-tone attention signal generator.

Accordingly, it is an object of the invention to provide a novel two-tone attention signal broadcasting system.

It is a still further object of the invention to provide a two-tone attention signal broadcasting system which is relatively inexpensive.

It is a still further object of the invention to provide a two-tone Attention signal broadcasting system with a relatively simple and inexpensive timing system which provides precise timing of the duration of the signals.

It is a still further object of the invention to provide a low distortion two-tone attention signal broadcasting system.

It is a still further object of the invention to provide a sine-wave generator which provides a low distortion sine-wave output signal from a square-wave input signal.

It is a still further object of the invention to provide a system for generating two frequencies from a single clock frequency and combining them into a two-tone sine-wave audio signal.

It is a still further object of the invention to provide a relatively inexpensive and simple timing system.

It is a still further object of the invention to provide an interrupt system for terminating the audio signal from a broadcasting station and transmitting instead of the audio signal, a two-tone attention signal to the amplification, modulation and transmitting equipment.

In accordance with the above and further objects of the invention, a two-tone attention signal broadcasting system includes an encoder and an interrupt switch. The interrupt switch interrupts the audio signal which is being transmitted from the studio to the modulation, amplification and broadcasting equipment upon the depressing of a manual switch and transmits instead a two-tone signal developed by the encoder for a fixed period of time between twenty seconds and 25 seconds. The two-tone signal is received by receivers forming part of the two-tone attention signal broadcasting system and decoded to provide an alarm and to demute certain radio receivers for the reception of further information.

The two-tone attention signal encoder includes as its principal parts, two frequency dividers, a clock pulse generator, sine-wave generators and a timer. The depressing of a manual switch used to initiate the two-tone attention signal: (1) applies a clock frequency to both frequency dividers; (2) applies a low potential to the frequency dividers so they begin dividing the clock pulses to the desired two tones for combination and application to the interrupt switch; (3) causes the interrupt switch to switch from reception of the audio signal sent by the broadcast studio to reception of the two-tone warning signal for application to the modulation, amplification and broadcast equipment; and (4) starts the timer.

The timer includes a series of counters which count a 60 Hertz signal from the mains supply for a set period of time, and at the end of this period of time, cause the interrupt switch to switch back to its original position and apply the reset signal to the counters. An abort switch is provided to prematurely cause the interrupt switch to switch back to reception of the audio signal from the broadcasting studio and to reapply the reset signal to the counters.

To insure that the digital signals provided by the dividers are in proper sine-wave form with low harmonic content for transmission, the digital signals are applied to the sine-wave generators. The sine-wave generators are either low-pass filters that remove all frequencies other than the fundamental frequency generally by operating in the time domain or combinations of differentiators and resonant tank circuits that differentiate the signals and then apply them to the resonant tank circuits which generate sine waves for combination into the two-tone signals. Because of the differentiation which forms energy waves appropriate for shaping, the sine waves have unexpectedly low distortion in spite of only rough tuning of the tank circuits or low-pass filters. It is particularly advantageous that these circuits do not have to be carefully tuned, and even if they are not closely tuned, a low distortion sine wave at the frequency of the differentiated signal applied to the circuits results. Moreover, the tank circuits do not need temperature compensation.

The interrupt switch includes a 6 dB pad which enables transmission from the tone combiner over an ordinary telephone line without increasing the distortion to an impermissible level. The use of the special sine-wave generators and the low distortion transmission from the interrupt switch enables the broadcast of a low distortion signal with relatively inexpensive circuitry.

From the above description, it can be understood that the two-tone attention signal broadcasting system of this invention has several advantages such as: (1) it is relatively inexpensive; (2) it maintains good frequency stability because of the digital generation of frequencies; (3) it has unexpectedly low harmonic distortion; and (4) the signals are accurately timed with a reliable and inexpensive digital timer.

The sine-wave generators are exceptionally simple and inexpensive because the tanks or low-pass filters do not have to be sharply tuned to provide low distortion outputs at the desired frequencies. The combined differentiators and tank circuits are the preferred embodiment because of their temperature stability. By differentiating the digital square-wave inputs prior to applying them to the tank circuits, preliminary energy shaping is performed which conserves energy and enables a low distortion sine-wave output.

The digital timing circuit is exceptionally accurate and inexpensive. Moreover, it is easy to control by the application of the reset control voltage to the counters. Similarly, the wave generator itself is easily controlled by the application of set pulses to the counters, thus removing the danger of large transients being propagated down the line when the two tones are first initiated. A further reduction in distortion is provided by the 6 dB pad at the audio output terminals of the encoder.

The above noted and other features of the invention will be better understood from the following detailed description when considered with reference to the accompanying drawings in which.

Figure 1:
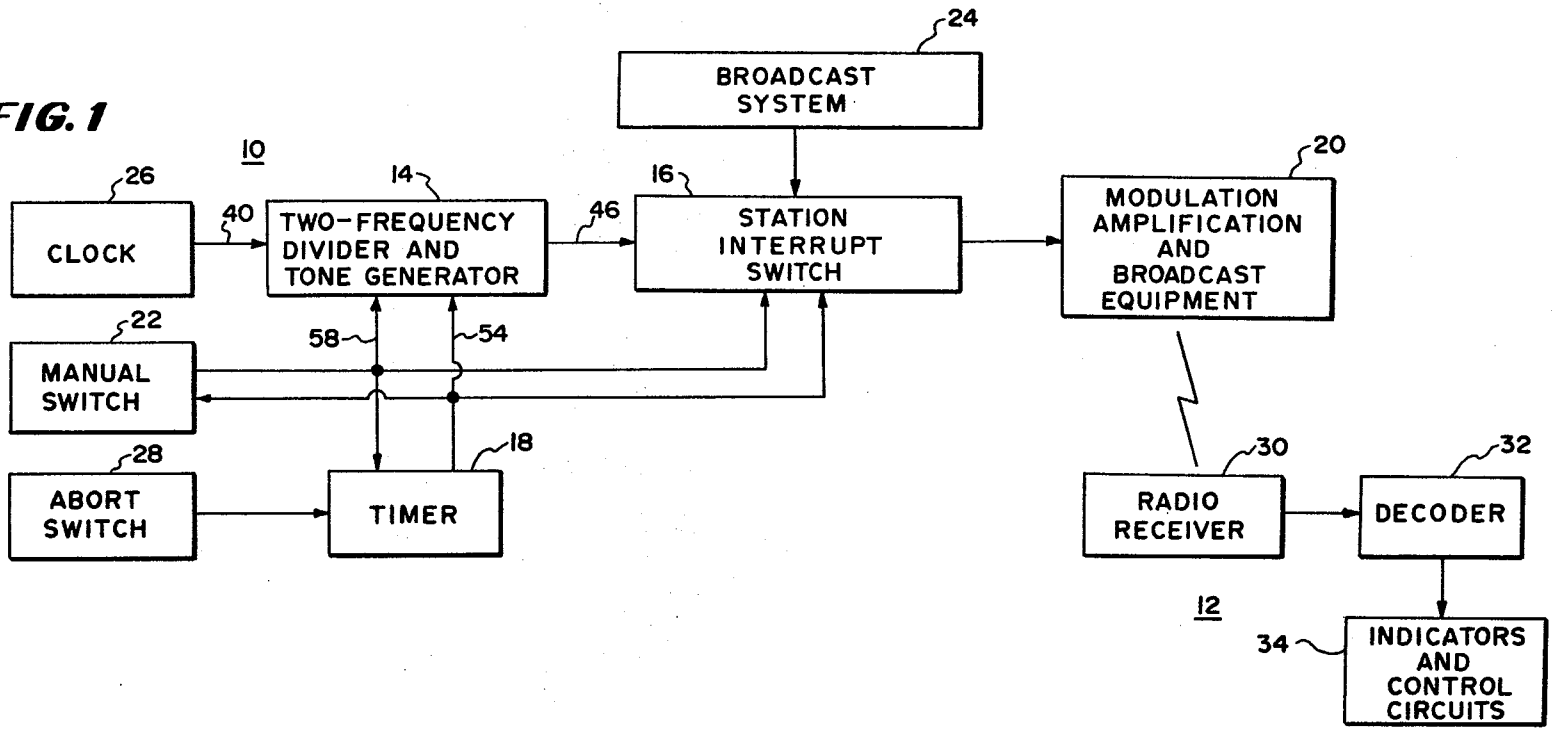
FIG. 1 is a block diagram of the two-tone attention signal broadcasting system of this invention.

In FIG. 1, there is shown a broadcasting system including a two-tone attention signal broadcasting system 10 and an attention signal receiving system 12. The two-tone attention signal broadcasting system 10 and the attention signal receiving system 12 are intended for use by any AM radio, FM radio or television broadcast station, or the general public. This program aids in the coordination of emergency activities such as rescue and evacuation of persons in threatened areas and alerts the general public of impending or eminent dangers such as approaching tornados, hurricanes or attacks upon the nation.

The two-tone attention signal broadcasting system 10 provides an attention signal that is received by the attention-signal receiving system 12, which responds by demuting otherwise silent receivers especially designed to demute or activate an alarm when a station to which they are tuned broadcasts the attention signal.

The two-tone attention signal broadcasting system 10 includes as its principal parts a two-frequency divider and tone generator 14, a station interrupt switch 16, and a timer 18. The two-frequency divider and tone generator 14 includes circuitry to generate the two different audio frequencies and then combine them for transmission. It is connected to the station interrupt switch 16, which provides the two tones to the modulation, amplification and broadcast equipment 20 during an emergency alert broadcast. The modulation, amplification and broadcast equipment 20 includes circuitry that modulates the two tones from the two-frequency divider and tone generator 14 and broadcasts the modulated tones to the attention-signal receiving system 12, one of which is incorporated in each radio and television broadcast station.

To provide a signal comprising two tones, each of which are precisely controlled to preset frequencies, the two-frequency divider and tone generator 14 is electrically connected to a clock 26 which generates an output frequency of 1.53575 MHz (megahertz). The clock frequency is a function of the mean of the 18th multiple of 853 Hertz, and the 16th multiple of 960 Hertz. The 1.53575 MHz signal is transmitted to two parallel divider circuits, one of which generates a first sine-wave tone of 853.194 Hertz and the other of which generates a second sine-wave tone of 959.844 Hertz. The first and second tones are combined and applied to the station interrupt switch 16. The clock 26 is a crystal-controlled multivibrator in the preferred embodiment but any precise source of oscillations may be used instead.

To initiate the broadcast of the attention signal, the two-tone attention signal broadcast system 10 also includes a start switch or manual switch 22 which is electrically connected to the two-frequency divider and tone generator 14, to the timer 18 and to the station interrupt switch 16. The actuation of this switch by an operator: (1) initiates the generation of the two tones by the two-frequency divider and tone generator 14 and applies them to the station interrupt switch; (2) starts a timer 18; and (3) causes the station interrupt switch to interrupt the normal programming signal from the broadcast system 24 to which it is electrically connected and to substitute an electrical connection to the two-frequency divider and tone generator 14 so that the two-tone signal is supplied for modulation of the carrier wave and broadcasting thereof instead of the normal program audio signal from the broadcast system 24.

To time the broadcasting of the attention signal, the timer 18, having been actuated by the manual switch 22, measures a 24 second time period and then applies a signal to the station interrupt switch 16 to which it is electrically connected, causing this switch to disconnect the two-frequency divider and tone generator 14 and electrically connect the broadcast system 24 to the modulation, amplification and broadcast equipment 20 to resume normal broadcast operation. The timer 18 also applies a signal at the same time to the two-frequency divider and tone generator 14 to inhibit the operation of this circuit.

In case the two-tone attention signal broadcasting system is accidentally energized, an abort switch 28 is provided, which, when energized, causes the timer 18 to immediately apply a signal to the station interrupt switch 16 and to the two-frequency divider and tone generator 14 to terminate the attention signal by an inhibiting control voltage to the two-tone frequency divider and tone generator 14 and disconnecting it from the modulation, amplification and broadcast equipment 20 and by opening the station interrupt switch 16. For some applications, two or more parallel-connected abort switches are used, one mounted to the encoder device's control panel and the other located externally for remote control. Both are transistor-transistor logic (TTL) compatible in the preferred embodiment, by proper selection of potential levels and impedances.

To receive and interpret the attention signal, the attention signal receiving system 12 includes a radio receiver 30, a decoder 32 and certain indicators and control circuits 34.

The radio receiver 30 may be either an AM, FM, or TV broadcast receiver, and is conventional in the nature of its operation and circuitry. It is electrically connected to the decoder 32 and applies the attention signal to this decoder. When the decoder recognizes the proper frequency tones, it energizes the indicators and control circuits 34 which demute the receiver which is normally silent, and allows the user to hear any announcements which follow the attention signal. A mode switch is also provided to allow the user to manually demute the receiver in order to facilitate tuning.

Most AM radio, FM radio and television broadcasting stations have both an attention signal broadcasting system and an attention signal receiving system. In a system such as that shown in FIG. 1 when an attention signal is not being broadcast, the normal audio signal from the studio is transmitted from the radio broadcast system 24, through the station interrupt switch 16 to the modulation, amplification and broadcast equipment 20 for broadcasting to the public. At this time, the radio receiver 30 is not applying an attention signal to its decoder 32, and the attention signal receiving system is not in use but is on and ready to receive an attention signal should it be broadcast.

In the event of an emergency or during routine testing, the two-tone attention signal broadcasting system 10 is put into operation by the application of the two-tone signals to the modulation, amplification and broadcast equipment 20 for broadcasting to the attention signal receiving systems 12. After a fixed period of time, the two-tone signal is terminated.

Before the two-tone attention signal is terminated, the attention signal receiving system 12 receives and decodes the signal, causing the demuting of certain receivers and indicating that an attention signal is being received. If an attention signal is accidentally initiated, the abort switch 28 is activated to stop the broadcast of the attention signal, and if the attention signal is stopped before a predetermined time has elapsed, avoiding the demuting of receivers and the indication that an attention signal has been broadcast.

To initiate a two-tone attention signal, the operator closes the manual switch 22. The manual switch enables dividers in the two-frequency divider and tone generator so that they divide the basic 1.53575 MHz output from the clock 26 to produce the approximately 960 and 853 hertz tones. These two tones are combined and applied to the station interrupt switch 16. The manual switch 22 also energizes the station interrupt switch 16 so that it disconnects the audio signal from the studio applied to it under normal programming conditions by the broadcast system 24 and connects the output from the two-frequency divider and tone generator 14 to the modulation, amplification and broadcast equipment 20 for broadcasting to the attention signal receiving system 12. When the manual switch 22 is closed, it also energizes the timer 18 which begins to time a 24 second period.

During the 24 seconds, the modulation, amplification and broadcast equipment 20 broadcasts the two-tone signal and each attention signal receiving system 12 within its range receives the signal in the receiver 30. The signal is demodulated and applied to the decoder 32 which recognizes it and applies signals to the indicator and control circuits 34 to demute certain receivers and provides an indication of the signal. The demuting and the alarm signals do not occur until after a 12 second time period has elapsed.

In order for the encoder to time the 24 second period and then terminate the two-tone attention signal, the timer 18 begins counting 60 Hertz pulses upon receiving an initiating signal from the closing of the manual switch 22. At the end of 24 seconds, it applies a signal to the two-frequency divider and tone generator 14 to inactivate the dividers and applies a signal to the station interrupt switch 16 to cause it to disconnect the two-frequency divider and tone generator 14 and reconnect the broadcast system 24 to the modulation, amplification and broadcast equipment 20.

If the two-frequency divider and tone generator 14 is inadvertently energized, the operator presses the abort switch 28, which causes a signal to be applied to the two-frequency divider and tone generator 14 to terminate the generation of the two tones and to the station interrupt switch 16 to reconnect the radio broadcast system 24 to the modulation, amplification and broadcast equipment 20 and disconnect the two-frequency divider and tone generator 14.

Figure 2:
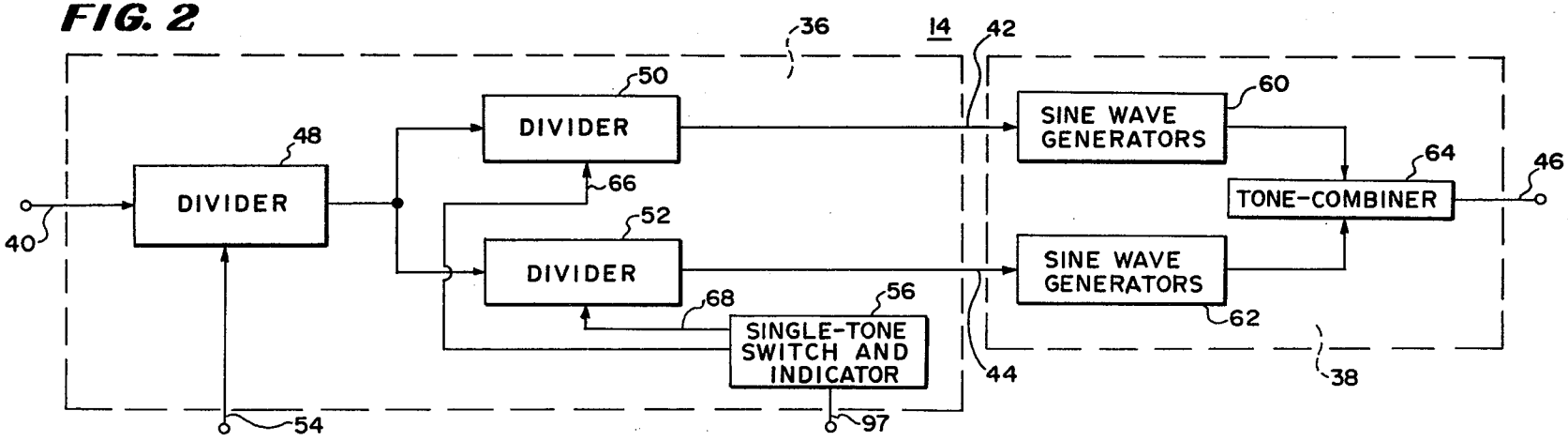
FIG. 2 is a block diagram of a portion of the broadcasting system of FIG. 1.

In FIG. 2 there is shown a block diagram of the two-frequency divider and tone generator 14 having a divider and single-tone switch 36 and a sine-wave generator and tone combiner 38. The divider and single-tone switch 36 receives the 1.53575 MHz from the clock 26 (FIG. 1) on conductor 40 and, when energized, applies the approximately 960 Hertz signal and the 853 Hertz signal to the sine-wave generator and tone combiner 38 over the conductors 42 and 44 respectively. The sine-wave generator and tone combiner 38 applies the two-tone attention signal to the station interrupt switch 16 (FIG. 1) over a conductor 46.

To generate the approximately 960 Hertz and 853 Hertz signals, the divider and a single-tone switch 36 includes a first divider circuit 48 and second and third divider circuits 50 and 52 respectively. The divider circuit 48 receives signals from the clock over conductor 40 and is activated by removing an inhibit signal applied to it over a conductor 54 which is de-energized only upon the depressing of the manual switch 22 (FIG. 1).

The divider circuit 48 is electrically connected to the inputs of the dividers 50 and 52 and supplies them with 15.3575 kHz (kilohertz) pulses after dividing the 1.53575 MHz clock oscillations received on conductor 40. The divider circuit 50 divides the pulses applied to it by 18 so as to provide an output through conductor 42 of approximately 853 Hertz and the divider 52 divides the input by 16 and provides an output of approximately 960 Hertz to the conductor 44, the conductors 44 and 42 being electrically connected to the sine-wave generator and tone combiner 38.

To check for the proper operation of the two-frequency divider and tone generator and to adjust the output level of each tone individually, there is provided a single-tone switch and indicator 56 which connects a clear signal from a source of power through a conductor 97 to a selected one of the dividers 50 and 52 when manually or automatically closed. The clear signal inhibits the divider to which it is applied. The output signal may be received by any suitable test equipment from the conductor 46. This circuitry also includes a ready lamp which indicates, when illuminated, that the circuit is not supplying a tone or two-tone signal to the output.

To generate sine waves from the square waves applied to conductors 42 and 44 by the dividers 50 and 52 and to combine them into a two-tone sine-wave signal, the sine-wave generator and tone combiner 38 includes first and second sine-wave generators 60 and 62 respectively and tone combiner 64, with the sine-wave generator 60 having its input connected to the divider 50 through the conductor 42 and the sine-wave generator 62 having its input connected to the divider 52 through the conductor 44. The output signals from the sine-wave generators 60 and 62 are connected to the tone combiner 64, which combines the sine waves formed in the sine-wave generators 60 and 62 and applies the two-tone sine-wave signal to the conductor 46 for broadcasting.

Figure 3:
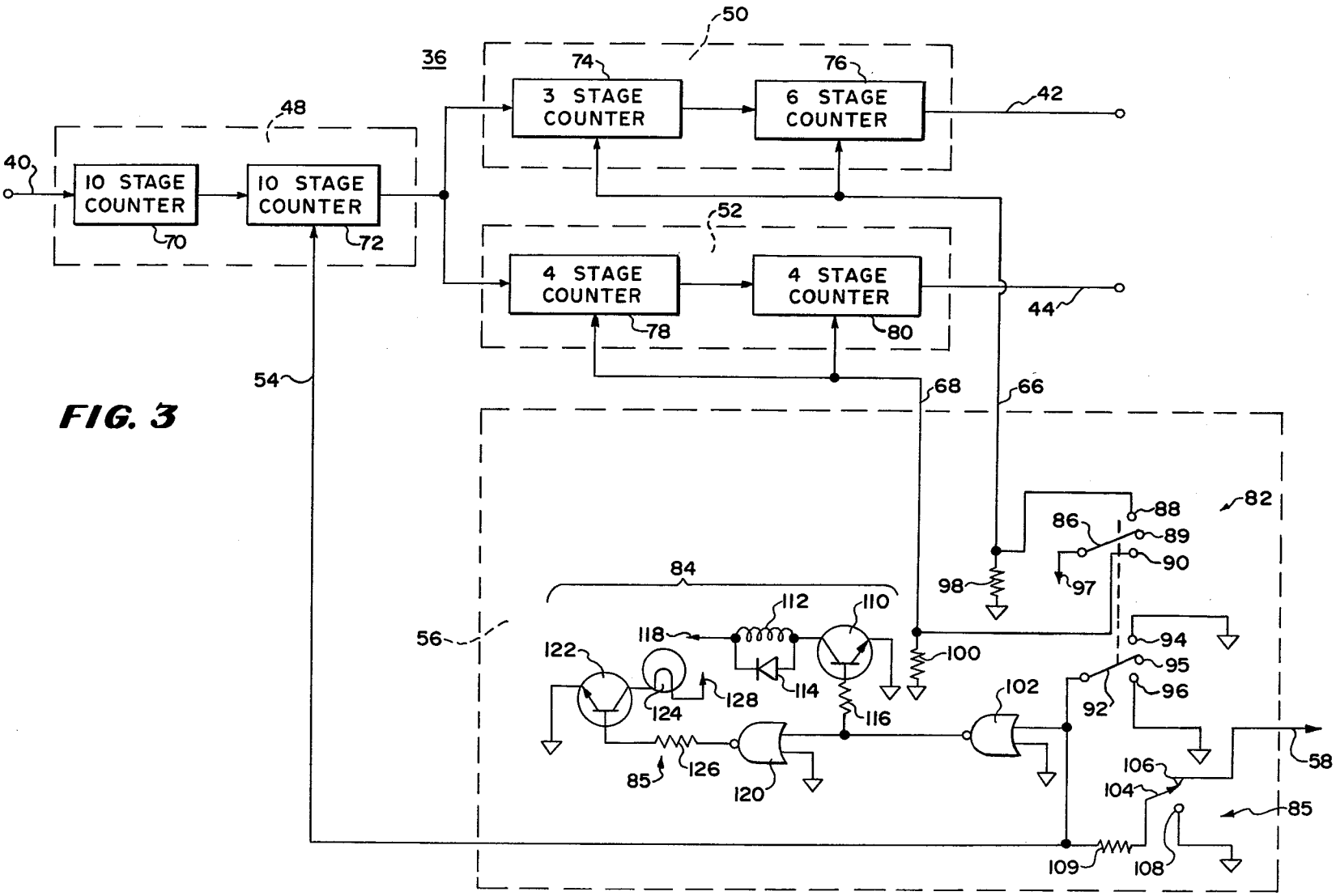
FIG. 3 is a block diagram of a portion of the system shown in FIG. 2.

In FIG. 3, there is shown more detailed block diagrams of the first, second and third dividers 48, 50 and 52 and of the single tone switch and indicator 56. As best shown in FIG. 3, the single tone switch and indicator 56 is electrically connected to the first divider circuit 48 through the conductor 54, to the manual switch 22 (FIG. 1) through the conductor 58 and to the second and third dividers 50 and 52 through two conductors 66 and 68 respectively.

To provide the 15.3575 kHz signal to the second and third dividers 50 and 52, the first divider 48 includes first and second 10-stage counters 70 and 72 connected in series, with the first 10-stage counter receiving the 1.53575 MHz signal on conductor 40 and applying 153.575 kHz to the second counter 72. The second counter 72 is electrically connected to the manual switch 22 (FIG. 1) through the single-tone switch and indicator 56 and conductor 54 through which it receives clear signals to control its operation. It is connected to and applies a 15.3575 kHz signal to the second and third counters 50 and 52 in parallel when not receiving the clear signal.

To generate the 853 Hertz signal for application to conductor 42 from the 15.3575 kHz signal applied to the second divider 50, the second divider 50 includes a three-stage counter 74 and a six-stage counter 76 connected in series, with the three-stage counter 74 receiving the 15.3575 kHz signal from the first divider 48, dividing it by three and applying its output signal to the six-stage counter 76, which generates the 853 Hertz signal and applies this signal to conductor 42.

To generate the 960 Hertz signal for application to conductor 44 from the 15.3575 kHz signal applied to the third divider 52, the third divider 52 includes a first four-stage counter 78 and a second four-stage counter 80, with the first four-stage counter 78 receiving 15.3575 kHz signal from the first divider 48, dividing it by four and applying it to the second four-stage counter 80, which again divides it by four and applies the resulting 960 Hertz signal to the conductor 44. The divider 52 may, in the alternative, include one 16-stage counter instead of the two four-stage counters 78 and 80, and the divider 50 may be substituted with a single 18-stage counter instead of the two counters 74 and 76.

To allow the application of the 853 Hertz and the 960 Hertz signals individually to the conductors 42 and 44 respectively, an inhibit input is connected to the three-stage counter 74 and six-stage counter 76 through conductor 66, and an inhibit input is connected to the four-stage counter 78 and the four-stage counter 80 through conductor 68. The conductors 68 and 66 are normally in a logical "1" condition, and are placed in a logical "0" condition only when the single-tone switch and indicator 56 is switched to one of its "on" positions.

To provide an indication when the encoder is ready to broadcast a two-tone attention signal, to enable the testing of individual tone generators during trouble shooting, to set the individual tone output levels, and to control the initiation of a two-tone signal, the single-tone switch and indicator 56 includes a selector switch 82, a ready indicator and switch circuit 84 and a counter-control relay-controlled switch 85.

To select one of the dividers 50 or 52 for testing, the selector switch 82 is a double-pole three-position transfer switch having: (1) a first switch arm 86 movable between a first stationary contact 88, a center or off position 89 and a third stationary contact 90; and (2) a second switch arm 92 movable between a first stationary contact 94, a center or off position 95 and a third stationary contact 96. The switch arm 86 is electrically connected to a source of positive potential 97 and the stationary contacts 88 and 90 are each connected to a respective one of the conductors 66 and 68 and the parallel resistive circuits 98 and 100 respectively, both of which are connected at their opposite ends to ground. The center contact is open.

The switch arm 92 is electrically connected to: (1) a first input of a NOR gate 102; and (2) to the junction between conductor 54 and a resistor 109 in parallel with the first input of the NOR gate 102. The other input of the NOR gate 102 is grounded, thus causing the NOR gate to operate as an invertor. The stationary contacts 94 and 96 are electrically connected to ground and the stationary center or off contact 95 is open.

To initiate a two-tone attention cycle or indicate that the equipment is ready for such a cycle, the counter-control relay-controlled switch 85 includes a switch arm 104, a first-relay contact 106 and a second-relay contact 108, with the first contact 106 being connected to a source of power through conductor 58 and a second contact 108 being connected to ground. The switch arm 104 is connected through a resistor 109 to the first input of the NOR gate 102, to switch arm 92 and to conductor 54, which connects it to the clear input of the 10-stage counter 72.

To indicate when the equipment is ready to transmit a two-tone attention signal or to actuate the interrupt switch 16 (FIG. 1) to connect the two-tone signal generator to the modulation, amplification and broadcast equipment 20, the indicator and switch circuit 84 includes a circuit for indicating when the equipment is ready to transmit a two-tone signal, a relay-control circuit for controlling interrupt switch 16 and the NOR gate 102.

To actuate the station interrupt switch 16 (FIG. 1), the indication and switch circuit 84 includes an NPN transistor 110, a relay winding 112, and a shut diode 114. The base of the transistor 110 is connected to the output of the NOR gate 102 through a resistor 116, its emitter is grounded and its collector is connected to a source of power 118 through the relay winding 112 and the reverse conduction path of the diode 114.

To provide the ready indication, the indication circuit 84 includes an NPN transistor 122, and a lamp 124. One input of the NOR gate 120 is connected to the output of the NOR gate 102 and its other input is grounded, the output of the NOR gate 120 being electrically connected to the base of the transistor 122 through a resistor 126. The emitter of the transistor 122 is grounded and its collector is electrically connected to one side of the filament of the lamp 124, the other side of the filament is connected to a source of power through conductor 128.

Before the manual button 290 (FIG. 6) is depressed to initiate a two-tone signal, the single-tone generators 50 and 52 are tested and adjusted individually. To individually test and adjust the output levels of the tone generators 50 and 52, potentiometers are set in each of the two-tone generators while that generator is individually operated as explained hereinafter.

To set the divider and single-tone switch 36 to permit the generation of a two-tone attention signal, the selector switch 82 is in its second or off position with the contact arms 86 and 92 contacting the unconnected contacts 89 and 95 respectively and the counter-control relay-controlled switch 85 is in its energized position with the armature 104 contacting the contact 106.

With the selector switch in this position, the counters 74, 76, 78 and 80 in the first and second dividers 50 and 52 receive ground-level clear signals on the conductors 66 and 68 which are connected through the resistors 98 and 100 to ground so that these counters are enabled and ready for operation. A positive signal is applied from the conductor 58 through the contact 106 and the armature 104 of the counter-control relay-controlled switch 85 through the resistor 109 and conductor 54 to the clear input of the counter 72 in the divider 48 so that it is inoperative and no signals are applied to the dividers 50 and 52, thus preventing generation of the two-tone signal. Similarly, a positive signal is applied to the resistor 109 to one input of the NOR gate 102, causing a logical "0" signal or a voltage of less than +0.8 volts to be applied to the base of the transistor 110 so as to prevent it from conducting, and therefore de-energizing the relay coil 112. This logical "0" signal is applied to one input of the NOR gate 120, resulting in a logical "1" input to the transistor 122 driving it to conduction and illuminating the lamp 124 to indicate the ready condition.

To initiate the two-tone attention signal, the manual switch 22 (FIG. 1) is depressed de-energizing a relay to be described hereinafter, which causes the armature 104 of the counter-control relay-controlled switch 85 to switch to stationary contact 108, thus grounding the input to the NOR gate 102 and the clear input to the ten-stage counter 72. This causes the divider 72 to begin counting and applying an output of 15,357.5 Hertz to the third dividers 50 and 52, which in turn further divide the signals and apply them to conductors 42 and 44 for eventual combining and transmission as two-tone signals.

The ground-level signal to the NOR gate 102 results in a logical "1" output that causes the transistor 110 to be driven to conduction, thus energizing the relay winding 112 to switch the interrupt switch 16 (FIG. 1). The logical "1" signal applied to the NOR gate 120 results in a logical "0" signal being applied to transistor 122 to cause the cutoff of this transistor and extinguishing of the lamp 124 to indicate operation of the unit to broadcast a two-tone attention signal.

To test and set the output levels of the third divider 52, the selector switch 82 is switched to its first position, with the first-contact arm 86 contacting the first-stationary contact 88 and the second contact arm 92 contacting the first-stationary contact 94. At this time, a two-tone attention signal is not being broadcast so that the armature 104 of the counter-control relay-controlled switch 85 is in contact with the stationary contact 106 and the ten-stage counter 72 receives a ground-level clear signal over conductor 54 from contact 94 to cause counting.

The source 97 applies a positive potential to the contact 88 to the clear inputs of the counters 74 and 76 in the second divider 50, thus keeping the second divider inactive. However, a ground signal continues to be applied to the clear inputs of the counters 78 and 80 of the third counter 52 through the resistor 100 so that this counter continues to be ready for operation.

This results in a 15.3575 KHz signal being applied to the second and third dividers 50 and 52. Since only the third divider 52 is in operative condition, it provides an output signal on conductor 44 which may be detected. If there is, however, a fault in this circuit, no signal will be applied at 44 or a signal of incorrect frequency will be applied and this can be detected to isolate the difficulty. Moreover, the output levels can be adjusted at this time by adjusting attenuators in the third divider.

Similarly, to test the second divider 50, the selector switch 82 is switched to its third position, with the switch arm 86 connected to the contact 90 and the switch 92 connected to the contact 96. The operation is the same as for the third divider and permits testing and adjustment of the second divider individually.

Figure 4:
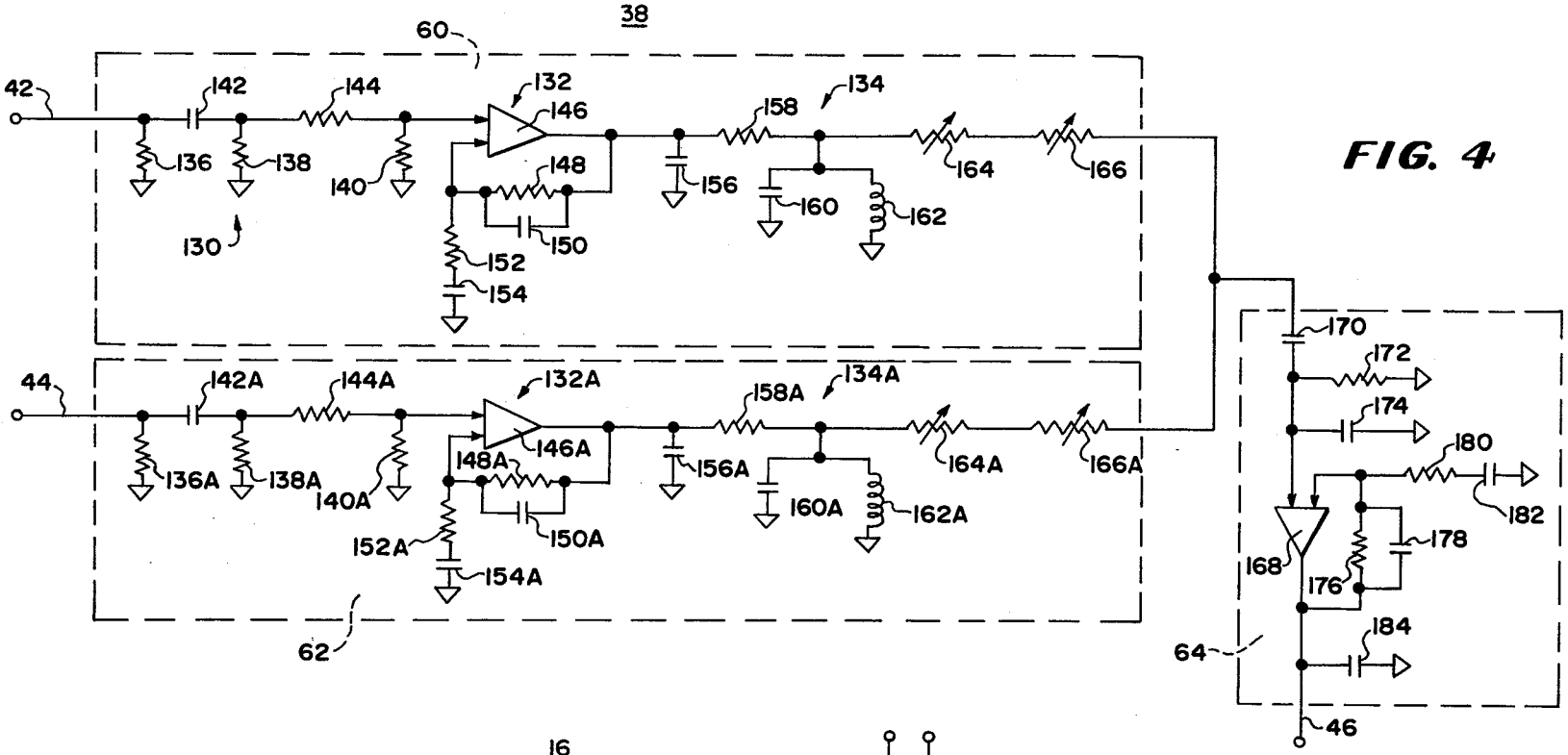
FIG. 4 is a schematic circuit diagram of a portion of the system shown in FIG. 1.

In FIG. 4, there is shown a schematic circuit diagram of the divider and power switch 38 with the first sine-wave generator 60 and the second sine-wave generator 62 shown in schematic circuit form connected to the tone combiner 64.

The first and second sine-wave generators 60 and 62 are substantially identical in structure and serve the purpose of converting the square waves which they receive at frequencies of approximately 853 Hertz and 960 Hertz respectively to sine waves at the same frequency. The sine waves are transmitted to the tone combiner 64 which combines them into a single two-tone audio signal.

To convert the square waves to sine waves, the sine-wave generator 60 includes a differentiator 130, an operational amplifier 132, and a tuned tank circuit 134 connected in series in the order named. The differentiating circuit 130 is an RC differentiating circuit having three parallel-connected resistors 136, 138 and 140, a series capacitor 142 and a series resistor 144, with: (1) one end of each of the parallel resistors 136, 138 and 140 being grounded; (2) the other end of the resistor 136 being connected to the conductor 42 and to one plate of the capacitor 142; (3) one end of the resistor 138 being connected to the other plate of the capacitor 42 and to one end of the series resistor 144; and (4) the other end of the parallel resistor 140 being connected to the second end of the series resistor 144 and to one input of an operational amplifier 146. With these connections, the 853 Hertz square waves are differentiated to provide alternating peaks to one input of the operational amplifier 146 and with alternating polarities.

The operational amplifier circuit 132 includes the operational amplifier 146, with its non-inverting input terminal receiving the signals from conductor 42 and its inverting input being connected in a feedback circuit from the output of the amplifier 132, which feedback circuit includes a parallel RC circuit composed of resistor 148 and high-frequency compensation capacitor 150 and a ground connection through an RC series circuit composed of an RC resistor 152 and a capacitor 154. The operational amplifier circuit 132 serves as a buffer between the tank circuit 134 and the differentiator 130 and amplifies the differentiated voltage pulses which are in the form of alternate positive and negative transitions occurring at opposite ends of the input square wave.

To convert the differentiated wave-form to a sine wave, the tank circuit 134 includes a capacitor 156 having one plate connected to the output of the operational amplifier 146 and its other plate grounded, a resistor 158 having one end connected to the output of the operational amplifier 146 and the other end connected to ground through two parallel paths, one of which includes a capacitor 160 and the other of which includes an inductor 162. Two series connected trimming resistors 164 and 166 are connected in series in the order named between the resistor 158 and the tone combiner 64 and serve to aid in adjusting the input voltage to tone combiner 64 from the tank circuit 134. The potentiometers 164 and 164A are set at the factory and adjusted to maximum output level for each tone generator. The potentiometers 166 and 166A are adjusted by the user to individually adjust the output levels of the single-tone generators 50 and 52 as described above.

The tank circuit 134 is relatively broad banded and does not have to be critically tuned. Moreover, it yields a surprisingly low amount of distortion components in response to the alternate spikes of potential applied across it. It is a surprising result that, by differentiating the square wave from the counter 76 and applying alternate peaks having energy of the correct polarity and correct amount to create the sine wave, an almost distortionless sine-wave output is provided, whereas the square waves provided to the same tank result in a sine wave with relatively-large distortion.

The sine-wave generator 62 contains the identical structural elements as the sine-wave generator 60 just described and these are labeled with the same numbers except for the suffix A. Of course this circuit is tuned to 960 Hertz rather than 853 Hertz.

To combine the 853 Hertz and 960 Hertz signals from the sine-wave generators 60 and 62 and transmit the combined tone to the conductor 46, the tone combiner 64 includes an operational amplifier 168, an input circuit, a feedback circuit and an output circuit, with: (1) the input circuit including two capacitors 170 and 174 and a resistor 172, the capacitor 170 having one plate connected to the output of both sine-wave generators 60 and 62 and the other plate connected to the positive input of the operational amplifier 68 and to ground through the parallel resistor and capacitor 172 and 174 respectively; (2) the feedback circuit including two resistors 176 and 180 and two capacitors 178 and 182, the inverting input of the operational amplifier 168 being connected to its output through the feedback parallel RC combination including resistor 176 and capacitor 178 and having its input grounded through the series connected resistor 180 and capacitor 182; and (3) the output circuit including a capacitor 184, the output of the operational amplifier 168 being connected to ground through the capacitor 184 and being connected to the output conductor 46. The tone combiner 64 serves primarily as a buffer and a power amplifier.

Figure 5:
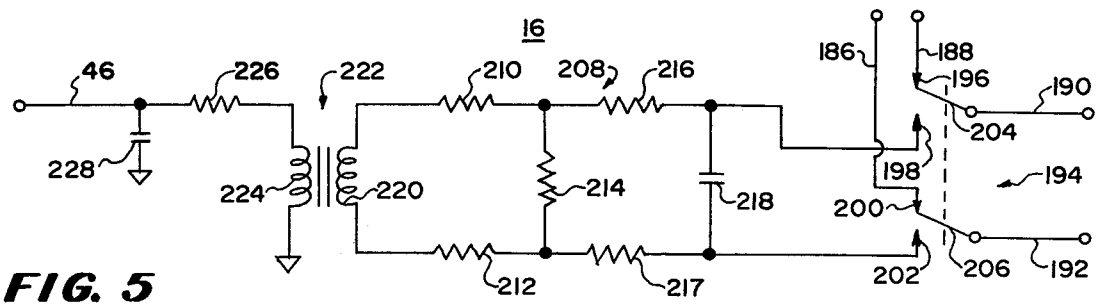
FIG. 5 is a schematic circuit diagram of a portion of the system shown in the block diagram of FIG. 1.

In FIG. 5, there is shown a schematic circuit diagram of the station interrupt switch 16 connected to receive the two-tone signal from conductor 46 and an audio signal from the radio broadcast system 24 (FIG. 1) on conductors 186 and 188 and to provide either a two-tone alert signal or the audio signal from the broadcast system 24 to the modulation, amplification and broadcast equipment 20 (FIG. 1) through conductors 190 and 192, which are generally telephone lines.

To select either the audio signal received on conductors 186 and 188 or the two-tone alert signal on conductor 46 for application to the conductors 190 and 192, the station interrupt switch 16 includes a double-pole double-throw relay-controlled switch 194 having stationary contacts 196, 198, 200 and 202 and moving switch arms 204 and 206.

When the double-throw double-pole switch 194 is in its normal position, the switch arms 204 and 206 electrically connect the conductors 188 and 186 respectively to the conductors 190 and 192, with the switch arms being normally connected to the conductors 190 and 192 being in contact in their normal position with the stationary contacts 196 and 200. When thrown to the alert position by the depressing of the manual switch 22 and consequent energization of relay winding 112 (FIG. 3), the switch arms 204 and 206 contact stationary contacts 198 and 202 respectively to connect the two-tone alert signal to the conductors 190 and 192 for application to the modulation, amplification and broadcast equipment 20 (FIG. 1).

Because the output of the operational amplifier has substantially negligible impedance, there is some danger of audio reflected from the end load being formed on conductor 46 during the transmission of the two-tone alert signal. To avoid this, a 6 decibel "H" pad 208 is connected between the conductor 46 and the double-pole double-throw switch 194 to attentuate reflected signals.

The 6 decibel H pad 208 includes a resistor network having resistors 210, 212, 214, 216 and 217 and a capacitor 218. The capacitor 218 has one plate connected to the contact 198 and to one end of the resistor 216 and the other plate connected to the contact 202 and one end of the resistor 217, the other end of the resistor 216 being connected to one end of each of the resistors 210 and 214 and the other end of the resistor 217 being connected to the other end of the resistor 214 and to one end of resistor 212.

To receive the signal from the conductor 46, the interrupt switch 16 includes a transformer 222 having a primary winding 224 and a secondary winding 220 and an RC circuit having a capacitor 228 and a resistor 226. Each of the other ends of the resistors 210 and 212 are connected to different ends of the secondary winding 220 of the transformer 222, the primary winding 224 of which is grounded at one end and connected at its other end to the conductor 46 through the resistor 226. One end of the resistor 226 and the conductor 46 is also connected to ground through a high-frequency by-pass capacitor 228. With these connections, the two-tone signal is applied to the contacts 198 and 202 through a network which attenuates energy reflected from the contact 198 and 202 to prevent excessive distortion in the two-tone alert signal.

Figure 6:
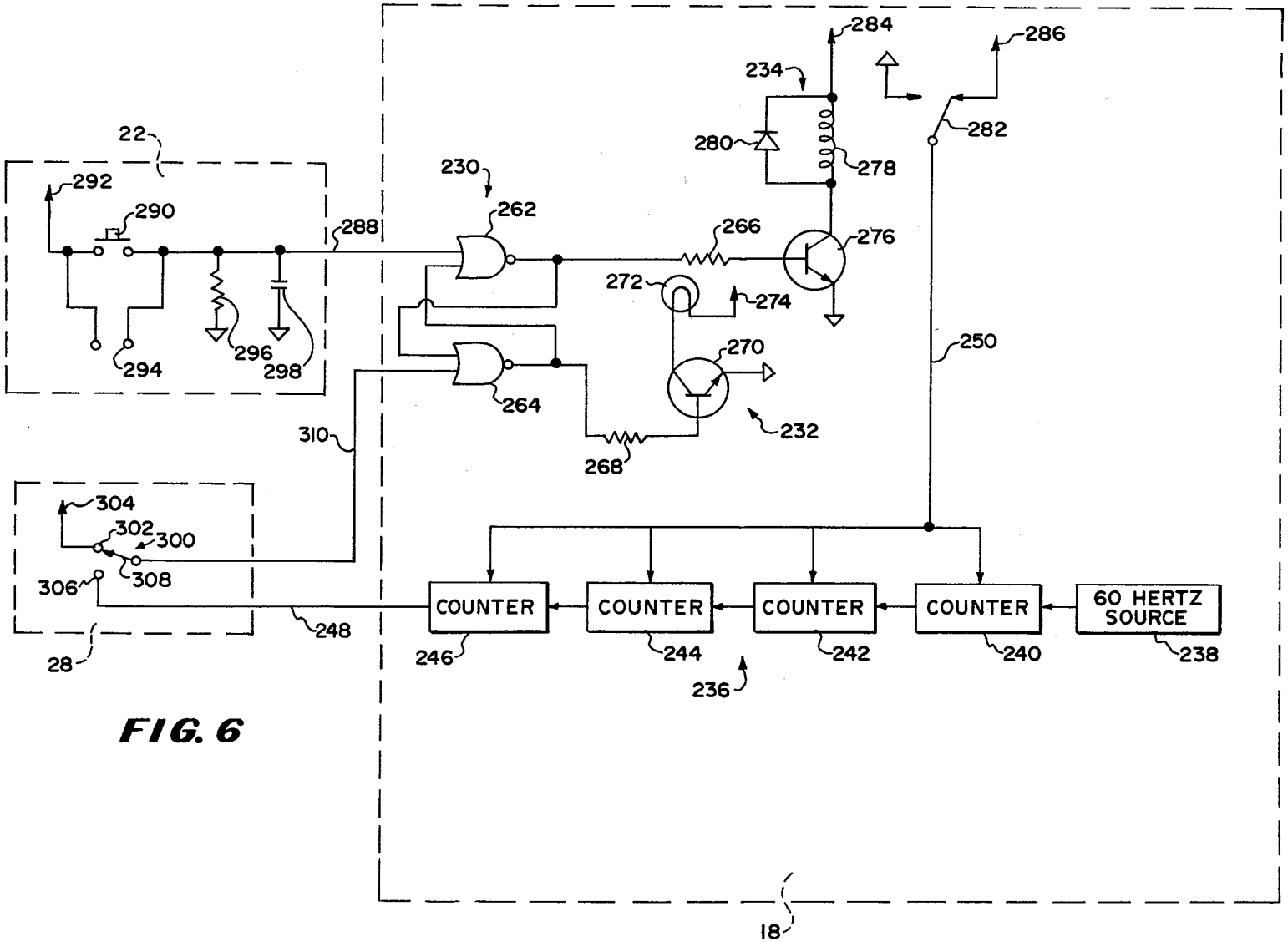
FIG. 6 is a diagram, partially schematic, partially logic and partially in block-diagram form of the portion of the system shown in FIG. 1.

In FIG. 6, there is shown a circuit diagram of the manual switch 22, abort switch 28 and timer 18, with the timer being connected to both the manual switch 22 and the abort switch 28.

The timer 18 includes a flip-flop 230, an alert warning lamp circuit 232, a relay circuit 234, and a counting circuit 236. The flip flop 230 interconnects the manual switch 22, the abort switch 28, the alert lamp circuit 232 and the relay 234 to control the relay 234, which in turn operates a double-pole double-throw switch 194 of the station interrupt switch 16 (FIGS. 1 and 5) and the counter-control relay-controlled switch 85 of the single-tone switch and indicator 56 (FIGS. 2 and 3).

To measure a 24 second interval, the counting circuit 236 within the timer 18 includes a 60 Hertz source 238, which may be the mains supply and four counters 240, 242, 244 and 246 electrically connected in series in the order named with the counter 240 having 12 stages, the counter 242 having 12 stages, the counter 244 having 10 stages and the counter 246 having two stages. The output of the last stage of the last counter 246 is applied to the abort switch 28 through a conductor 248 and a ground-level signal or a clear signal is applied to the counters through a conductor 250 to enable them to count or to clear them and prevent counting.

To control the counting circuit 236 and the alert warning lamp circuit 232, the flip flop 230 includes first and second NOR gates 262 and 264, with the output of NOR gate 262 being connected to one input of NOR gate 264 and the output of NOR gate 264 being electrically connected to one input of NOR gate 262 in the conventional manner for NOR gate flip flops. To set the flip flop 230, the other input of the NOR gate 262 is electrically connected to the manual switch 22 and its output is electrically connected to the relay circuit 234 through a resistor 266. The output of the NOR gate 264 is electrically connected to the lamp circuit 232 through a resistor 268 and its input is electrically connected to the abort circuit 28.

To indicate when a two-tone attention signal is being transmitted, the alert warning lamp circuit 232 includes an NPN transistor 270 and a lamp 272, with: (1) the base of the NPN transistor 270 being connected to the output of NOR gate 264 through a resistor 268; (2) its emitter being grounded; and (3) its collector connected to a source of positive potential 274 through the lamp 272.

To control the station interrupt switch 16 and the counter-control relay-controlled switch 85, the relay circuit 234 inludes an NPN transistor 276, relay winding 278, diode 280, and a first set of contacts 282. Other contacts operated by the energization of the relay winding 278 are within the single-tone switch and indicator 56 (FIGS. 2 and 3).

To energize the winding 278, the NPN transistor 276 has its base connected to the output of the NOR gate 262 through the resistor 266, its emitter grounded, and its collector connected to a source of power 284 through the winding 278 which is shunted by the diode 280, the anode of which is connected to the collector of the NPN transistor 276 on one end of the relay winding 278 and the cathode of which is connected to the source 284 at the other end of the relay winding 278. With these connections, the movable contact of the relay switch 282 is normally connected to a source of power 286 to clear the counters 240 through 246 when the relay winding 278 is energized and is connected to ground when the relay winding 278 is de-energized to permit the counters 240–246 to count.

To initiate an attention signal, the manual switch 22 has an output conductor 288 electrically connected to one of the inputs of the NOR gate 262 and a push-button switch 290 that when depressed connects the conductor 288 to a source of positive potential 292 and when released disconnects the source of potential. A pair of external contacts 292 may be used to short the push-button switch for automatic or remote control operation. A bypassing circuit is connected between the switch 290 and the output conductor 288, comprising a capacitor 298, with one plate of the capacitor being connected to the conductor 288 between the input of NOR gate 262 and the push-button switch 290 and their other end being grounded. Resistor 296 acts to assure that the conductor 288 is held at a ground potential when the switch 290 is not being depressed.

To abort the attention signal if accidentally initiated, the abort switch 28 includes a single-pole double-throw switch 300 having a first fixed contact 302 connected to a positive potential at 304 and a second contact 306 connected to the output of the counter 246 to receive a count 24 seconds after the activation of the counters 240–246. The armature 308 of the single-pole double-throw switch 300 is electrically connected to one of the inputs of the NOR gate 264 through a conductor 310 to apply a logical "1" potential to the input of the NOR gate 264 when the single-pole double-throw switch 300 has its switch arm 308 connected to contact 302 and to receive the final count of counter 246 when connected to the contact 306.

With this arrangement, the output from the counter 246 is applied to one of the inputs of the NOR gate 264 through conductor 310 at the end of 24 seconds from the depressing of the manual switch 22 unless the single-pole double-throw switch 300 is moved to contact 302 before the end of a twenty-four second period. At the end of 24 seconds, the output of counter 248 resets the flip-flop 230 by switching to a logical "1" state.

In the operation of the timer 18, the push-button switch 290 in the manual switch 22 is depressed to initiate an attention signal. Depressing the manual switch 22 sets the NOR gate flip-flop 230 to de-energize the winding 278 in the relay circuit 234 and illuminate the lamp 272, causing the switch arm 182 to switch from the source of potential 286 to ground.

When the contact arm 282 is grounded, a clear signal is removed from the counters 240–246, and they begin counting the 60 Hz signals from the source 238 until a logical "1" signal is applied through conductor 248 to the input of the NOR gate 264 through conductor 310 to reset the flip-flop 230 and energize the relay winding 278. The de-energization of the relay winding 278 also grounds the switch arm 104 of the counter-control relay-controlled switch 85 (FIG. 3) to initiate the generation of the two-tone alert signal and energizes winding 112 (FIG. 3) to switch the double-pole double-throw relay switch 194 (FIG. 5) of the interrupt switch 16 (FIG. 1) into position to apply the two-tone attention signal to the modulation, amplification and broadcast equipment 20.

If it is desired to interrupt the broadcasting of the two-tone attention signal, the abort switch 28 is switched manually from the contact 306 to the contact 302 to switch the NOR gate flip-flop 230 to its reset state, thus energizing the relay winding 278 and causing illumination of the ready lamp 124 (FIG. 3).

To apply a signal to NOR gate 262 in initiating the attention signal, the depressing of push-button switch 290 causes a positive potential from the source 292 to be applied through the circuit that includes resistor 296 and capacitor 298 to one input of the NOR gate 262 through conductor 288. The application of a positive potential to the NOR gate 262, causes the flip-flop 230 to switch to its set state, with a ground output from the NOR gate 262 being applied to one of the two inputs of the NOR gate 264, the other input being grounded through conductor 310 which is connected to the output of the counter 246.

When the flip-flop 230 is set, the output from the NOR 262 is switched from a positive output to a ground-level output and this output is applied to the base of the NPN transistor 276 through the resistor 266. This output causes the transistor 276 to become nonconductive thus de-energizing the relay winding 278 and causing the switch arm 282 to be grounded and enable the counters 240–246. Also, the NOR gate 264 switches from a ground-level output signal to a positive signal when flip-flop 230 is set, thus applying a positive signal to the base of the NPN transistor 270 to drive it to conduction and illuminate the warning lamp 272.

To continue the broadcasting of the two-tone alert signal for 24 seconds, the ground-level signal applied through conductor 250 from the relay switch 234 upon the depressing of the push-button switch 290, enables the counters 240–246. When the counters 240–246 are enabled, the 60 Hz signals applied from the 60 Hz source 238 is applied to the input of the first counter 240, which applies one pulse to the input of counter 242 for each 12 pulses received from the 60 Hz source 238. The 60 Hz source 238 includes a Schmitt trigger for providing well-shaped square-wave pulses to the counter 240 and its trigger is connected to the mains supply.

The counter 242 applies a square-wave pulse to the input of the counter 244 each time it receives 12 pulses from the counter 240, and the counter 244 applies one pulse to the input of the counter 246 for each 10 pulses it receives from the counter 242. The counter 246 is a binary counter and applies one pulse to the contact 306 in the abort switch 28 through the conductor 248 for each two pulses it receives so that a pulse is applied to the conductor 248 24 seconds after the counters 240–246 are energized.

When the switch 308 of the abort switch 28 is connected to contact 306, the output from the counter 246 is applied through the abort switch 28 to conductor 310. This output is connected to one of the inputs of the NOR gate 264 of flip-flop 230, and causes flip-flop 230 to be reset 24 seconds after it has been set by depressing push-button switch 290, thus de-energizing the lamp 272 and energizing the relay winding 278 so as to terminate the two-tone attention signal.

Figure 7:
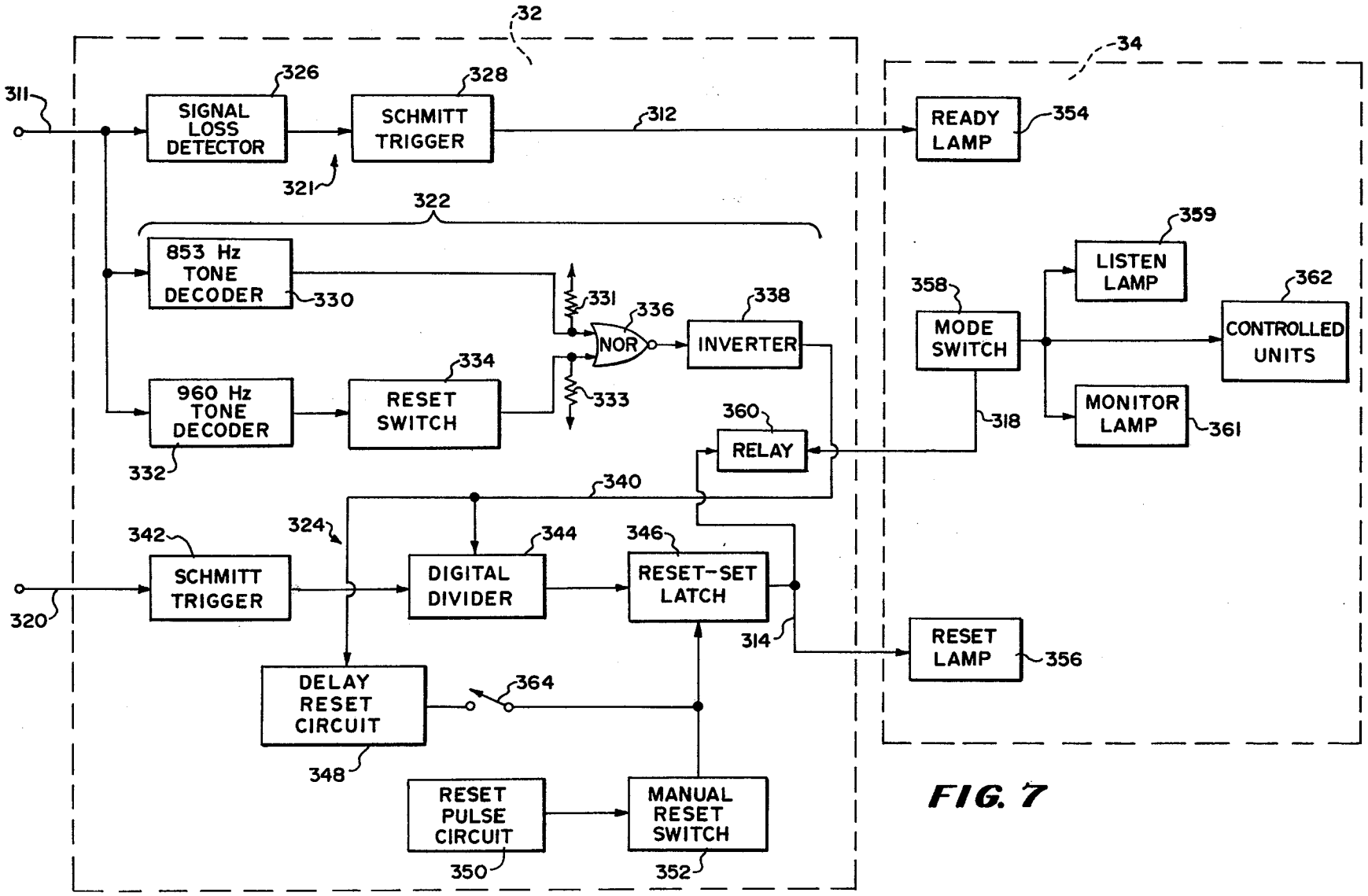
FIG. 7 is a block diagram of a portion of the system shown in FIG. 1.

In FIG. 7, there is shown a block diagram of a decoder 32 and an indicator and control circuit 34 of the type included in the attention signal receiving system 12 (FIG. 1) to decode the received two-tone attention signal when broadcast by the two-tone attention signal broadcasting system, to provide an indication of the reception of a two-tone attention signal and to energize certain other selected control circuitry such as radio circuitry or the like.

The radio receiver 30 (FIG. 1) applies audio signals to the decoder 32 through conductor 311 and timing pulses are applied to the same unit through the conductor 320. The decoder 32 and the indicator and the control circuits 34 are connected to each other by the conductors 312, 314, and 318.

To decode the audio signal received on conductor 311, the decoder 32 includes a signal loss detector circuit 321, a two-tone detection circuit 322, and a timing circuit 324. The signal loss circuit 321 provides a signal to the indicator and control circuits 34 over conductor 312 to indicate termination of the broadcast audio signal, the two-tone detector 322 detects the presence of the two-tone attention signal and the timing circuit 324 enables certain circuits to be reset and set accordingly within the indicator and control circuits 34.

To detect the loss of the audio input signal at input 311 and provide an indication to conductor 312, the signal loss circuit 321 includes a signal loss detector 326 which detects the audio signal and applies a voltage established by the audio signal to a Schmitt trigger 328 the output of which is connected to conductor 312. The Schmitt trigger 328 is triggered by the detector 326 whenever a signal is present and its output is switched off whenever there is no signal so that the conductor 312 is energized when a signal is present and de-energized when there is no signal.

To detect the 853 Hz and 960 Hz signals, the two-tone detector 322 includes an 853 Hz tone decoder 330, a 960 Hz tone decoder 322, a reset switch 334, a NOR gate 336, and an inverter 338. The 853 Hz tone decoder 330 and the 960 Hz tone decoder 322 are each connected to the conductor 311 to receive the audio signals, with the output from the 853 Hz tone decoder 330 being applied to one input of the NOR gate 336 and the output of the 960 Hz tone decoder 332 being applied to the other of the two inputs of the NOR gate 336 through the reset switch 334. The output of the NOR gate 336 is inverted in the inverter 338 and applied to the timing circuit 324 through conductor 340. A first pull-up resistor 331 is connected at one end to one of the inputs to NOR gate 336 and at its other end to a source of positive potential and a second pullup resistor 333 is connected at one end to the other input to NOR gate 336 and at its other end to a source of positive potential.

The tone decoders 330 and 332 detect 853 Hz and 960 Hz signals respectively and provide a ground connection indicating reception. If either is not receiving a signal, its pullup resistor provides a positive potential capable of actuating the NOR gate 336 and a ground level when tone decoder 330 receives an 853 Hz signal and decoder 332 receives a 960 Hz signal. Suitable decoders are sold by Signetics Corporation by number NE567V and are tunable to the desired frequency.

The reset switch 334 opens the circuit between the 960 Hz tone decoder 332 and one input of the NOR gate 336 when the decoder is reset after receiving a two-tone attention signal to temporarily pulse the inverter 338 and clear the timing circuit 324.

To time the two-tone alert signal, the timing circuit 324 utilizes a source of 60 Hz signals applied to conductor 320, a Schmitt trigger 342, a digital divider 344, a reset-set latch 346, a delay reset circuit 348, a reset pulse circuit 350, and a manual reset switch 352.

The digital divider 344 includes three counters, the first two of which are 12-stage counters and the third of which is a 10-stage counter, connected in series to provide a division of 1440 or a 12 second time period to count 60 cycle pulses transmitted by the Schmitt trigger 342. The counters receive at the input of the first counter the output of the Schmitt trigger 342 and apply a logical "1" output to the input terminal of the reset-set latch 346 after completing one-half output count. They count only when enabled by the absence of a potential on conductor 340 from the inverter 338.

The voltage on conductor 340 from the inverter 338 is also applied to a delay reset circuit 348. The delay reset circuit 348 delays the pulse for approximately 2 minutes in the preferred embodiment and applies a pulse at the end of this period to the reset input terminal of the reset-set latch 346. With this arrangement, the timing circuit and the monitoring circuits 34 are automatically reset after 2 minutes even though the switch 352 has not been closed. Otherwise, such resetting must be performed by depressing the reset switch 352 which is also connected to the reset input terminal of the reset-set latch 346.

The manual reset switch 352 is a momentary contact type switch and has its input connected to a reset pulse circuit 350. The reset pulse circuit 350 includes a source of potential and a reactance which generate a pulse when power is first applied to the decoder. The depressing of a manual switch in the reset switch 352, at the same time, opens the reset switch 334 in the two-tone detector 322 and applies a momentary logical "1" potential to the timer 324 to switch it to its reset state.

To indicate the loss of the audio signal or the reception of a two-tone attention signal, the indicator and control circuit 34 includes a ready lamp 354, a reset lamp 356, a listen lamp 359, and a monitor lamp 361. The ready lamp 354 is connected to conductor 312 and receives a positive potential whenever an audio signal is present on conductor 311. Therefore, when the lamp 354 is illuminated, an audio signal is being received and when it is extinguished, the signal has been lost.

To indicate that a two-tone attention signal has been received, the reset lamp 356 is illuminated when the reset-set latch 346 has been set and indicates that an attention signal is, or has been, received. It is extinguished when switch 352 is depressed.

To control external circuits and to provide an indication of the existence of a two-tone attention signal, the indicator and control circuits 34 include a mode switch 358, a relay 360 and certain controlled units 362. The mode switch 358 is a double-pole double-throw switch, which in one position applies a source of potential to the monitor lamp 361 and in the other position connects the controlled units 362 and the relay 360 to the output of the reset-set latch 346 to energize the relay 360 and energize the controlled units 362 upon the reception of a two-tone attention signal.

In the operation of the decoder shown in FIG. 7, an audio input from the radio receiver 30 (FIG. 1) is applied to conductor 311 whenever a signal is being received. If this signal is lost, the signal loss detector 326 discontinues the application of a signal to the Schmitt trigger 328 so as to extinguish the ready lamp 354, thus notifying the user that a signal has been lost. The ready lamp 354 is illuminated whenever a signal is being received whether it is an audio signal from a broadcasting studio or the two-tone attention signal.

When a two-tone attention signal is braodcast modulated with signals at 853 Hz and 960 Hz, the 853 Hz tone decoder 330 and the 960 Hz tone decoder 332, both of which are phase-locked loop type circuits, apply logical "0" signals to the two inputs of the NOR gate 336. These two signals result in the NOR gate 336 going high and applying a positive voltage to the inverter 338 which inverts it and removes a clear signal from the digital divider 344.

When the clear signal is removed, the digital divider 344 begins counting pulses applied to it from the Schmitt trigger 342 in response to the 60 Hz mains line signals on conductor 320. After 1440 counts, the digital divider 344 applies a signal to the set input of the reset-set latch 346, setting this latch to energize the relay 360 and the reset lamp 356. The lamp 356 may be extinguished by depressing the manual reset switch 352 so as to apply a pulse to the reset-set latch 346.

If the switch 352 is not depressed, the delay reset circuit 348 applies a signal to the reset input terminal of the reset-set latch 346 upon the expiration of 2 minutes to reset the relay 360 and the lamp 356. The delay reset circuit 348 is an optional circuit which may be included for example in home radios and the like so as to deactivate any controlled circuits such as a speaker automatically after a period of time. The controlled units 362 are alternate units to those controlled by the relay 360.

Figure 8:
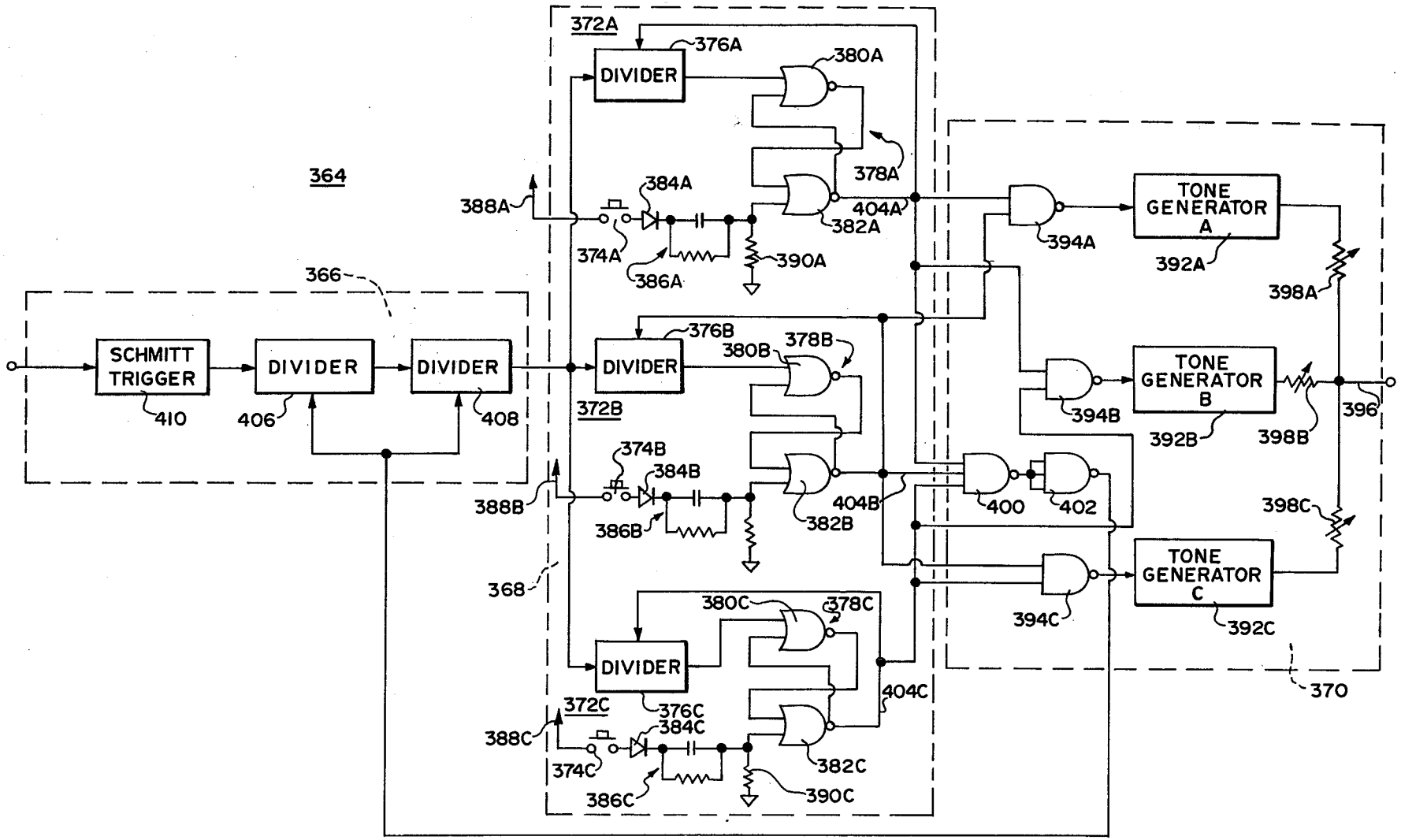
FIG. 8 is a signaling system showing a manner in which a timing circuit which is a portion of the system of FIG. 1 may be used in other similar systems.

In FIG. 8, there is shown a signaling system 346 for generating a plurality of combinations of tones such as are used for remote control systems and the like including the improved timing system shown at 18 in FIG. 6. The signaling system 364 includes a timer 366 similar to the timer 18 shown in FIG. 6, a tone-selection circuit 368 and a tone-generating system 370. The tone-selection system 368 energizes certain sections of the tone-generating section 370 in response to manual operation and starts the timing section 364, which terminates the generation of the tones after a predetermined time.

To select the frequencies of the signaling tone, the tone-selection section 368 includes three identical frequency-energization sections 372A–372C, one for each tone generator in the tone-generation section 370. Each of the frequency-energization sections 372A–372C includes a corresponding one of the three manual push-button switches 374A–374C, dividers 376A–376C and three flip-flops 378A–378C.

In the frequency-energization section 372A, the flip-flop 378A includes two NOR gates 380A and 382A, with one of the two inputs of the NOR gate 382A being connected to the manual switch 374A through the diode 384A and a parallel RC circuit 386A, the other contact of the manual push-button switch 374A being connected to the source of potential 388A. This input to the NOR gate 382A is also connected to ground through a resistor 390A so that when the manual push-button switch 374A is depressed, a pulse is applied to the input across the resistor by the connection of the source of positive potential 388A to the junction between the resistor 390A and the one input of the NOR gate 382A through the RC circuit 386A. The other input of the NOR gate 382A is connected to the output of the NOR gate 380A and the output of the flip-flop 378A is connected to the generation section 370 and to the divider 376A.

The input of the divider 376A is connected to the timing circuit 366 to receive input pulses as well as to the output of the NOR gate 382A so that it receives its input count from timing circuit 366 and is enabled and begins counting that input upon receiving the abscence of a clear input from the output of the NOR gate 382A, the output of the divider 376A being applied to one of the inputs of the NOR gate 380A.

With these connections, the closing of the manual switch 374A causes the flip-flop 378A to apply an output to the tone-generating circuit 370, and after a period of time, an input from the timing circuit 366 to the divider 376A resets the flip-flop 378A to terminate the signal.

The tone-generating sections 372B and 372C have similar connections and operate in a similar manner so that the depressing of manual switches 374B–374C selects the frequencies that are to be applied to the output conductor 396 by the tone-generating circuit 370.

The tone-generating section 370, includes three tone generators 392A, 392B, and 392C, each being connected for energization to a corresponding one of the NAND gates 394A–394C and having its output connected to an output conductor 396 through a corresponding one of the level adjustment potentiometers 398A–398C. The tone generator 370 also includes two series-connected NAND gates 400 and 402 for aiding in the control of the time duration of the tones. NAND gate 402 may, in the alternative, be replaced by an inverter. The tone generators 392A–392C each generate a different frequency and may by any type of tone generator.

The NAND gate 400 has three inputs, each of which is connected to a different one of the frequency energization sections 372A–372C through corresponding ones of the output conductors 404A–404C, each of which is connected to the output of a corresponding one of the NOR gates 382A–382C.

To time the tones applied to the output conductor 396, the timing circuit 366 includes a divider 406 and a divider 408, which are digital binary type counters and are connected in series, with the clear terminal of both counters being connected to the output of the NAND gate 402 to begin a timing operation, the input of the divider 406 being connected to the output of a Schmitt trigger 410 which receives 60 Hz pulses from the mains supply, or any other clocking source, and the output of the counter 408 being connected to each of the dividers 376A–376C.

With these connections, whenever one of the buttons 374A–374C is depressed, the output from the NAND gate 402 energizes the counters 406 and 408 by removing the clear (or reset) input which then begin counting at a 60 Hz rate.

Before operating the signaling system 364 shown in FIG. 8, the output conductors from the frequency energization sections 372A–372C are connected to selected ones of the tone generators 392A–392C in the tone-generator station. Any combination of connections may be made and there may be any number of tone generators so that the energization of any output conductor can provide any selected combination of frequencies to the output conductor 396 for any duration as a signaling tone.

A selected combination of generators is energized by pushing one of the buttons of the manual switches 374A–374C. The selected switch applies a pulse to the corresponding NOR gate 382A–382C, setting the flip-flop of which that NOR gate is a part and causing a logical "0" output state to be applied through the corresponding conductors 404A–404C to the NAND gate 394A–394C to which it is connected as well as to the NAND gate 400. This logic state is also applied to the divider or flip-flops 376A–376C which allows the divider to begin counting.

The input to the selected NAND gate 394A–394C causes the NAND gate to provide a high input to its corresponding tone generator 392A–392C which responds with an output frequency on the output conductor 396. The amplitude of the signals applied to the conductor 396 is adjusted by the potentiometers 398A–398C.

The output from NAND gate 400 is applied to the NAND gate 402 which serves as an inverter to provide a signal to the reset terminals of the dividers 406 and 408 to initiate counting by them. The counting is done in response to the 60 Hz pulses from the Schmitt trigger 410 which is energized from the mains line or some other source of periodic pulses or signals. The output from the divider 408 is applied to the flip-flop or dividers 376A–376C in each of the energization stages to cause them to be enabled so as to switch the flip-flops 378A–378C to their reset state and terminate the signals to the NAND gate 394A–384C, thus terminating the output signals to conductor 396.

It can be understood from the above description that the two-tone attention signal broadcasting system of this invention has the advantages of: (1) being relatively simple in construction and inexpensive; (2) having low distortion; (3) having accuracy in the timing of the period of the two-tone attention signal; and (4) having stability in the frequencies of the two tones.

The timing system is especially simple and economical particularly when embodied in the form of integrated circuitry and has other uses as well as in a two-tone attention signal broadcasting system. The low distortion is the result of superior sine-wave generators and the proper impedance arrangement in the switch which interrupts the signal from the broadcast studio and transmits the two-tone attention signal instead to the modulation, amplification and antennas for broadcasting.

Although a preferred embodiment has been described in some detail, many modifications and variations in the invention are possible in the light of the above teachings. It is therefore to be understood that, within the scope of the appended claims, the invention may be practiced other than as specifically described.

What is claimed is:

1. A signaling system for broadcast by broadcast equipment on carrier frequencies normally used for other broadcasts comprising:

an encoder;

a timer;

a source of audio signals for broadcasting at a carrier frequency;

an interrupt switch means for electrically operatively connecting said source of audio signals to said broadcast equipment for transmission at one time and for electrically operatively connecting said encoder to said broadcast equipment at other times;

said encoder including means for generating digital signals at two predetermined frequencies, converting said digital signals to sine waves and combining said sine waves for application to said interrupt switch;

said timer including means for switching said interrupt switch means from said encoder back to said source of said audio signals a predetermined time after said interrupt switch means has been switched from audio signals to said encoder; and switch means for actuating said interrupt switch means to connect said encoder to said broadcast equipment and for starting said timer;

said encoder including a source of clock pulses, a first frequency divider, and a second frequency divider;

said first and second frequency dividers each having a different input terminal;

each of said input terminals being connected to a source of clock pulses;

said first and second frequency dividers including counters each of which has a different reset input terminal; and means for applying a signal to at least one of said reset input terminals to energize said counters.

2. A system according to claim 1 in which said encoder further comprises:

first means for generating sine waves;

second means for generating sine waves;

said first and second means for generating sine waves being respectively connected to said first and second frequency dividers; and said first and second means for generating sine waves each including a different differentiator for differentiating said digital signals and a different tank circuit for receiving differentiated signals to generate sine wave signals.

3. A system according to claim 1 in which said encoder further comprises means for generating sine waves from digital signals;

said means for generating sine waves being connected to said frequency dividers; and said means for generating sine waves including at least one differentiating means for differentiating said digital signals from said frequency divider and at least one means for forming sine waves from said differentiated signals.

4. A system according to claim 3 in which said timer comprises a counter adapted to be connected to a source of clock pulses, said counter comprising:

an output terminal for providing a pulse after a predetermined number of counts;

reset means whereby said counter is reset;

the output of said counter being connected to said interrupt means for actuation thereof after a predetermined period of time; and said reset input of said counter being connected to said switch means for starting said timing period.

5. A system according to claim 4 in which said interrupt switch means includes:

a first transmission line;

a second transmission line;

switching means having at least first and second stationary contacts and a movable contact;

an attenuator;

said first transmission line being adapted to be connected at one end to said encoder and at the other end to said attenuator;

said attenuator being connected to said first stationary contact;

said second stationary contact being connected to one end of said second transmission line;

said second end of said second transmission line being adapted to be connected to a broadcast studio for the reception of audio signals; and said movable contact being adapted to being connected to said broadcasting equipment.

6. A system according to claim 5 in which said attenuator has the same characteristic impedance as said first transmission line.

7. A system according to claim 3 in which said means for forming sine waves includes a tank circuit.

8. A system according to claim 7 in which said tank circuit is substantially resonant at the frequency of said digital signals.

9. A system according to claim 4 including control means for applying a clear signal to said counter to prevent counting and removing said clear signal to start counting, said control means being operatively electrically connected to at least said switch means.

10. A system according to claim 1 in which said timer comprises a counter adapted to be connected to a source of clock pulses, said counter comprising:

an output terminal for providing a pulse after a predetermined number of counts;

reset means whereby said counter is reset;

the output of said counter being connected to said interrupt means for actuation thereof after a predetermined period of time; and said reset input of said counter being connected to said switch means for starting said timing period.

11. A system according to claim 1 in which said interrupt switch means includes:

a first transmission line;

a second transmission line;

switching means having at least first and second stationary contacts and a movable contact;

an attenuator;

said first transmission line being adapted to be connected at one end to said encoder and at the other end to said attenuator;

said attenuator being connected to said first stationary contact;

said second stationary contact being connected to one end of said second transmission line;

said second end of said second transmission line being adapted to be connected to a broadcast studio for the reception of audio signals; and said movable contact being adapted to being connected to said broadcasting equipment.

12. A signaling system according to claim 1 in which said means for generating includes:

a 1.53 megahertz clock pulse generator;

first divider means electrically connected to said clock pulse generator for dividing said 1.53 megahertz clock pulses into 15.35 kilohertz pulses;

second divider means for dividing said 15.35 kilohertz pulses into 853 hertz pulses and third divider means for dividing said 15.35 kilohertz pulses into 960 hertz pulses; and means for converting 960 hertz pulses and 853 hertz pulses into combined 960 hertz sine wave signals and 853 hertz sine wave signals.

13. A signaling system according to claim 1 in which:

said timer further includes means for enabling said means for generating at the beginning of said predetermined time and disabling said means for generating upon expiration of said predetermined time; and said signaling system further including manually-operable abort switch means for causing said timer to switch said interrupt switch means from said encoder back to said source of audio signals and for disabling said means for generating upon activation of said abort switch.

14. A signaling system in accordance with claim 13 in which:

said means for generating includes a clock pulse generator and a plurality of counters for dividing the pulses from said clock pulse generator; and said timer including means for applying a first signal to certain of said counters to prevent generation of said digital signals and for applying a second signal to said certain of said counters to permit generation of said digital signals without interruption of the generation of clock pulses from said clock pulse generator.

15. A signaling system in accordance with claim 14 further including means for enabling one of said certain counters and disabling the other of said certain counters, whereby one signal may be detected and tested to isolate faults in part of said system.

16. A signaling system in accordance with claim 1 in which said means for generating is electrically connected to said interrupt switch means through a 6 decible attenuater.

17. A receiver-decoder for receiving signals broadcast by broadcasting equipment on carrier frequencies normally used for other broadcasts, comprising:

means for receiving said carrier frequency and detecting said signal thereon;

means for providing an indication to a user of the receiver-decoder when said signal is received;

means for indicating when an audio signal is being received including a detecting circuit for detecting the signal and a lamp connected in circuit with said detecting circuit for detecting the signal, whereby said lamp is illuminated to indicate the presence of an audio signal;

trigger means having its input connected to said detecting circuit means for detecting said signal and its output connected to said lamp;

reset circuit;

said reset circuit including a manual reset button and a pulse circuit;

said pulse circuit including means for producing a reset pulse when power is first applied to the receiver-decoder, whereby the receiver-decoder starts in the reset mode.

18. A receiver-decoder in accordance with claim 17 further including at least one delay reset means to automatically reset the alarm after a predetermined period of time has elapsed after the reception of an attention signal.

19. A receiver-decoder according to claim 17 in which said means for receiving said carrier frequency includes an 853 hertz tone decoder and a 960 hertz tone decoder having their outputs electrically connected to a gating circuit to indicate the reception of both 853 hertz tones and 960 hertz tones.

* * * * *

UNITED STATES PATENT AND TRADEMARK OFFICE

CERTIFICATE OF CORRECTION

PATENT NO. : 4,103,235

DATED : July 25, 1978

INVENTOR(S) : Patrick Doyle Bryant

It is certified that error appears in the above-identified patent and that said Letters Patent are hereby corrected as shown below:

Column 14, line 52, the numeral 182 should be 282.

Column 15, line 20, after "NOR" should be "gate".

Column 16, line 34, the numeral 322 should be 332.

Column 16, line 36, the numeral 322 should be 332.

Column 18, line 28, the numeral 346 should be 364.

Column 20, line 22, the word "gate" should be "gates".

Signed and Sealed this

*Third* Day of *April 1979*

[SEAL]

*Attest:*

RUTH C. MASON
*Attesting Officer*

DONALD W. BANNER
*Commissioner of Patents and Trademarks*